United States Patent [19]

Knispel

[11] 3,987,979

[45] Oct. 26, 1976

[54] YARN DISTRIBUTION APPARATUS

[76] Inventor: Irving Knispel, 705 Westmount Drive, Los Angeles, Calif. 90069

[22] Filed: May 14, 1975

[21] Appl. No.: 577,287

[52] U.S. Cl. ..... 242/136; 242/141

[51] Int. Cl.[2] ..... B65H 49/18

[58] Field of Search ..... 242/129.5, 136, 139, 242/141

[56] References Cited

UNITED STATES PATENTS

| | | | |
|---|---|---|---|
| 1,169,967 | 2/1916 | Kent | 242/136 |
| 1,208,502 | 12/1916 | Crowley | 242/136 |

FOREIGN PATENTS OR APPLICATIONS

| | | | |
|---|---|---|---|
| 2,103 | 1/1914 | United Kingdom | 242/136 |

*Primary Examiner*—Leonard D. Christian

[57] ABSTRACT

A yarn holding and distribution apparatus for supporting pre-wound balls or skeins of yarn making same readily accessible for knitting, crocheting or like activities. A flexible frame adapted to receive either the pre-wound balls or skeins of yarn is typically supported from an overhanging support arm, the bottom of the yarn supporting frame incorporating a spherical pivot to slideably contact the base of the yarn supporting apparatus. The yarn held upon the supporting frame will be feed therefrom in a uniform manner irrespective of whether the yarn leader is at the top of or beneath the spherical pivot member.

5 Claims, 5 Drawing Figures

YARN DISTRIBUTION APPARATUS

BACKGROUND OF THE INVENTION

1. Field of the Invention

The present invention is generally related to yarn holding devices having component parts for supporting yarn skeins or pre-wound balls and, particularly directed to devices which facilitate the distribution of supported yarn.

2. Prior Art

With the increased popularity of knitting, crocheting or other like hobbies, it is increasingly evident that more sophisticated devices are necessary to aid the person performing these arts. Yarn adapted for home use generally comes in either prewound balls or in butterfly skeins, either configuration making it difficult to distribute the yarn without tangeling same. Several devices have been disclosed in the prior art to facilitate the yarn distribution feature, but all incorporate deficiencies which have been substantially resolved by the present invention.

One of the devices disclosed by the prior art is a conventional knitting reel which includes a centrally disposed cone which is rotatable about its axis. The skein of yarn or pre-wound ball is disposed upon the rotatable cone in a manner which is supposed to facilitate the feeding of the yarn leader. This conventional knitting reel has inherent inadequacies which the present invention is intended to resolve. Where skeins of yarn are utilized, it is clear that it is extremely difficult to properly mount the skein of yarn on the cone to provide for appropriate feeding of the yarn. This is particularly true where the yarn is not uniformly disposed within the skein. In addition, the rotating reel makes it extremely difficult to clear tangled sections of yarn. The present invention resolves this difficulty by utilizing a component particularly adapted to skeins of yarn or pre-wound cylinders which will automatically clear any tangles which are formed.

Another device disclosed by the prior art utilizes a bobbin which is pivotally mounted from an upper support, the bottom of the bobbin being revolvably mounted within a recessed cavity or socket. The difficulty with this type of device is clear. Where a skein of yarn is wound about the bobbin, the yarn leader will tend to drop down around the base of the bobbin. Where the lower portion of the bobbin is secured within a cavity or recessed socket, there is no way that the tangled yarn can be cleared without removing the bobbin from the mounting. The present invention solves this problem by utilizing a spherical lower member which pivotally rotates about its axis on a supporting base. Where the yarn leader drops around the base, the yarn support frame can swing about its pivotal mounting, the spherical member easily lifting off of the base to provide for feeding the yarn.

Another device disclosed by the prior art is a yarn ball support which is pivotally mounted from an upper frame. Once the ball of yarn is disposed upon the yarn support, the action of feeding the yarn feeder will cause the convolutely wound yarn to drop from the yarn support and therefore defeat a primary object of these types of devices.

The present invention substantially resolves those problems found in the devices found in the prior art. A yarn supporting frame can be utilized with either a pre-would ball of yarn or a butterfly skein. Once the yarn is mounted upon the yarn support frame, it can be pivotally dispensed irrespective of the position of the yarn leader. A lower spherical member is caused to pivot around its axis thereby providing for uniform distribution of the yarn while being moveable in a manner which will prevent tangling of the yarn leader.

SUMMARY OF THE INVENTION

The gist of the present invention is a yarn distribution apparatus which can be used with either pre-wound balls of yarn or with butterfly skeins of yarn. Yarn supporting frames are adapted to receive either the pre-wound balls of yarn or be wound with yarn which comes from the manufacturer in butterfly skeins. With respect to the latter configuration, it had heretofore been the practice to merely wind the skeins of yarn into a ball from which the yarn was supposed to be distributed. The yarn supporting frame has an upper portion which is formed into an apex having extending flanges depending therefrom. The lower portion of the yarn supporting frame is horizontal and has integral with this a spherical member which is uniformly disposed on the bottom portion of the yarn supporting frame and aligned with the apex thereof. The apex of the yarn supporting frame is coupled to a swivel or other means which would permit the yarn supporting frame to rotate about the axis of the apex.

The rotatable yarn supporting frame is secured to a distributing base which will facilitate the objectives of the present invention. The spherical member of the yarn supporting frame is in slidable contact with a planar surface. The frame is supported in a manner which will permit the yarn supporting frame to rotate about the axis of the spherical member while simultaneously permitting the lower portion of the yarn supporting frame to be moved about the apex of the frame. In this manner, where the yarn leader inadvertently drops intermediate the spherical member and planar base, the yarn leader can be pulled through by merely causing the yarn supporting frame to pivot about its apex and lift clear of the base. In addition, the yarn supporting frame can be mounted upon the users wrist or other appropriate portion of the users body to provide for a second distributing source of yarn or be used as the primary distribution point.

It is therefore an object of the present invention to provide an improved yarn distribution apparatus.

It is another object of the present invention to provide a yarn distributing apparatus that can utilize either pre-wound balls of yarn or butterfly skeins.

It is still another object of the present invention to provide a yarn distribution apparatus which will preclude tangling of the yarn leader.

It is still yet another object of the present invention to provide a yarn distribution apparatus which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
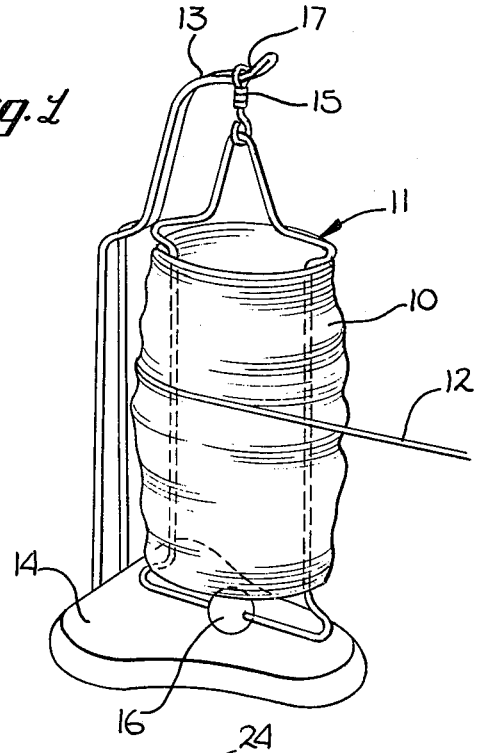
FIG. 1 is a front perspective view of the present invention yarn distribution apparatus illustrating a mounted butterfly skein of yarn.

Referring now to FIG. 1, a better understanding of the structure of the present invention can be best gained. FIG. 1 illustrates the present invention yarn distribution apparatus feeding yarn 10 wound from a butterfly skein. Yarn 10 is wound about yarn supporting frame 11, yarn leader 12 being distributed from the present invention in the manner to be described hereinbelow. Yarn supporting frame 11 is coupled to cradle 17 of overhanging arm 13 which in turn is secured to a horizontal base platform 14. Arm 13 and platform 14 provide sufficient room for yarn supporting frame 11 to rotate without striking or otherwise being interfered with by any portion of the supporting elements.

Yarn supporting frame 11 is pivotally secured to arm 13 by way of swivel 15. Swivel 15 is preferably coupled to arm 13 in a manner which would permit disengagement of the element. In addition, since yarn supporting frame 11 can take different forms (FIGS. 2*a* and 2*b*), frame 11 should be disengageable from swivel 15. The bottom portion of yarn supporting frame 11 includes a spherical pivot 16. Spherical pivot 16 is uniformly disposed along the bottom portion of yarn supporting frame 11 and slidably contacts the surface of platform 14. In the configuration shown in FIG. 1, the interval intermediate arm 13 and platform 14 insures that yarn supporting frame 11 will hang vertically from cradle 17 while permitting spherical pivot 16 to slidably contact the surface of platform 14.

Figure 2B:
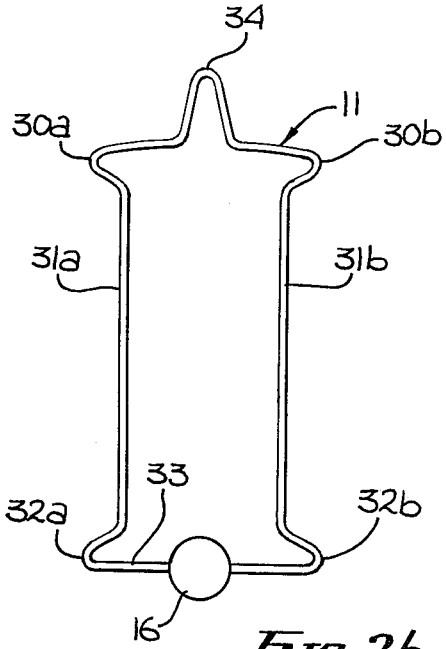
FIG. 2*b* illustrates a side elevation view of a yarn supporting frame used for mounting yarn skeins.
Figure 2A:
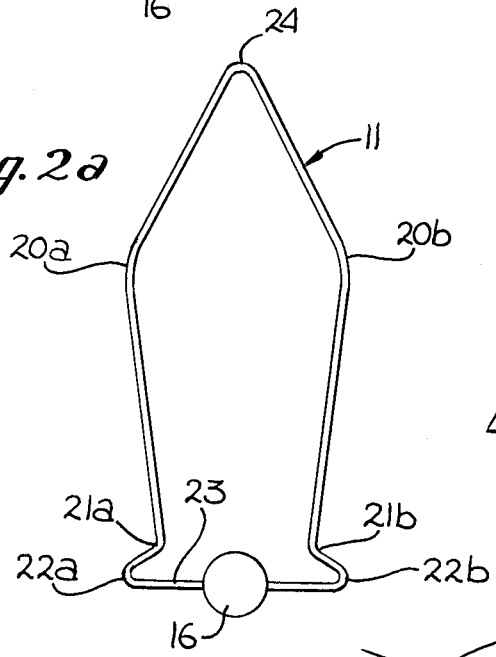
FIG. 2*a* illustrates a side elevation view of a yarn supporting frame used for mounting pre-wound balls of yarn.

Referring now to FIG. 2*a* to FIG. 2*b*, alternative forms of yarn supporting frame 11 can be best seen. As stated hereinabove, it is an object of the present invention to permit utilization of both pre-wound yarn as well as butterfly skeins of yarn. The form of yarn supporting frame 11 shown in FIG. 2*a* is adapted to be used with pre-wound cylinders of yarn. The form of yarn supporting frame 11 shown in FIG. 2*a* utilizes a flexible wire frame having a pair of shoulder portions 20*a* and 20*b* tapering inwardly to resilient base portions 21*a* and 21*b*, tapered portions 21*a* and 21*b* flaring outwardly to extensions 22*a* and 22*b*. The bottom section 23 is adapted to be disposed horizontal to platform 14. Disposed uniformly along bottom section 23 and aligned with apex 24 is spherical pivot 16 as shown in FIG. 1. Although the preferred form of the present invention utilizes a spherical pivot as identified by the reference numeral 16, it is obvious to one having skill in the art that pivot 16 can take other geometrical shapes which would provide for an area of limited contact with platform 14. As stated previously, the form of yarn supporting frame 11 shown in FIG. 2*a* is to be utilized with pre-formed cylinders of yarn. When the cylinder is disposed over apex 24 and down around shoulders 20*a* and 20*b*, the shoulders 20*a* and 20*b* will be resiliently urged inwardly in a manner sufficient to receive the cylinder of yarn. The cylinder will rest upon extensions 22*a* and 22*b* and secured by the outward resilient movement of shoulders 20*a* and 20*b*.

Referring now to FIG. 2*b*, a form for yarn supporting frame 11 for use with butterfly skeins of yarn can be best seen. As shown in FIG. 2*b*, apex 34 depends outwardly into two opposed shoulders 30*a* and 30*b*. Shoulders 30*a* and 30*b* depend inwardly into parallel sections 31*a* and 31*b*. The bottom terminus of sections 31*a* and 31*b* depend outwardly into lower shoulder sections 32*a* and 32*b* which are similar in size to shoulder portions 30*a* and 30*b*. As with the case of the form of the yarn supporting frame shown in FIG. 2*a*, shoulder sections 32*a* and 32*b* depend inwardly at common bottom section 33 in a manner which is adapted to be parallel to platform 14. In accordance with that described in connection with FIG. 2*a*, spherical pivot 16 is uniformly mounted on bottom section 33 in alignment with apex 34. In addition, although a spherical configuration is the preferred form for pivot 16, any other geometrical shape can be used which would insure a limited contact area between pivot 16 and platform 14. The form of the yarn support frame 11 shown in FIG. 2*b* is used with a butterfly skein of yarn. As described previously, it has been common practice to take a butterfly skein and merely wind the yarn into a uniform ball which is then distributed from some container which would keep the ball from unraveling. In this case, the yarn is wound about parallel sections 31*a* and 31*b* and bounded by the respective shoulders 30*a*–30*b* and 32*a*–32*b*.

Figure 3:
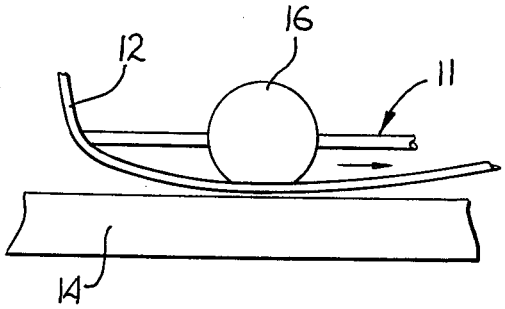
FIG. 3 is an enlarged, side elevation view of the contact between the yarn supporting frame and the base therefore permitting the release of tangled yarn leader.

Irrespective of which form yarn supporting frame 11 is utilized, it is an object of the present invention to provide a yarn distribution apparatus which will prevent the tangling of the yarn as it is fed from the frame 11. Referring now to FIG. 3, the manner in which the present invention solves the problem dealing with tangling yarn can be best seen. As stated hereinabove, the standard position for yarn supporting frame 11 provides for vertical orientation thereof from cradle 17, pivot 16 slidably contacting the surface of platform 14. FIG. 3 illustrates the problem sought to be solved. Where yarn leader 12 slips from the position shown in FIG. 1, the present invention provides specific means for clearing yarn leader 12 without having to disengage yarn supporting frame 11 thereby precluding the unwanted tangling of leader 12. When leader 12 drops under spherical pivot 16, any lateral force urged against pivot 16 by leader 12 will cause lateral movement of pivot 16 and the associated yarn supporting frame 11. Since yarn supporting frame 11 is being held from cradle 17 in a manner which will permit pivot 16 to rotate about its axis on platform 14 and also permit pivot 16 to laterally slide along platform 14 when it is urged to do so, yarn leader 12 will be freed merely by imposing such force on pivot 16. As was described in connection with the prior art, the use of a socket or cavity to secure the bottom portion of a yarn supporting frame will produce a result which is totally opposite from that sought by the present invention. In the case of the present invention, the force imposed on pivot 16 by moving yarn leader 12 will cause lateral sliding movement of pivot 16 and the associated frame 11 and thereby provide for a simplified procedure for distributing that portion of yarn leader 12 which had slipped from frame 11 into a position which would create tangling difficulties.

Figure 4:
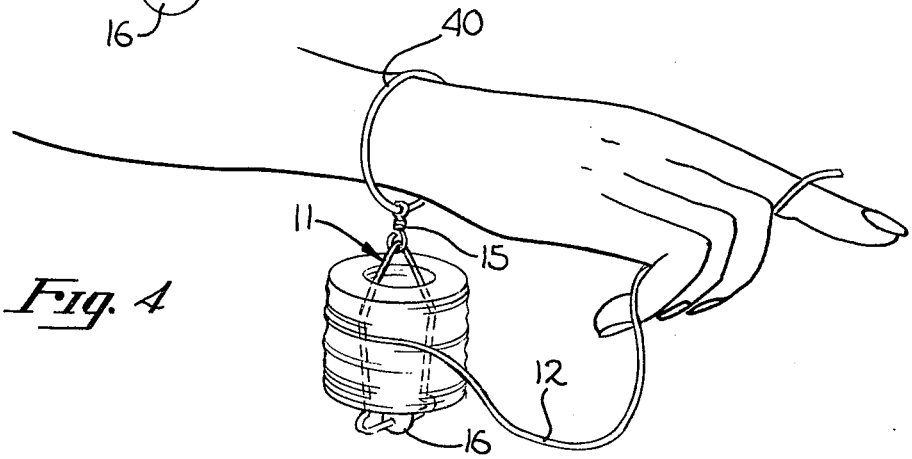
FIG. 4 illustrates an alternative mounting for the yarn supporting frame upon the user's arm.

The use of yarn supporting frame 11 in a hand held position can be best seen by reference to FIG. 4. As stated previously, swivel 15 is disengageable from cradle 17 in a manner which will permit it to be mounted upon an alternative supporting arm. In this case, the arm of the user has a removeable bracelet 40 disposed thereon. Swivel 15 is coupled to bracelet 40 in a manner which will permit the distribution of yarn as exemplified by yarn leader 12. In this manner, a user can employ two different yarn sources, one being from the configuration such as that shown in FIG. 1 and the second source from that shown in FIG. 4.

It can therefore be seen that the present invention provides for an improved distribution device to be used in knitting and crocheting. The present invention freely permits rotational distribution of the yarn from a prewound cylinder of yarn or from a butterfly skein of yarn which is wound about an appropriate form of yarn supporting frame 11. The form of yarn supporting frame 11 is hung from arm 13 in a manner which will permit pivot 16 to rotate about its axis on platform 14 or alterally slide along platform 14 when urged by a portion of yarn leader 12 which has slipped from the conventional distribution area. The present invention provides for a simple and inexpensive device for using both sources of yarn in a manner which alleviates previously unresolved problems.

I claim:

1. A yarn distribution apparatus comprising:

a. a planar platform;

b. a supporting arm depending upwardly from said platform and extending laterally over a portion of said platform;

c. yarn supporting means comprising a laterally resilient frame having an apex depending downwardly and laterally outwardly into a first pair of shoulder members, said shoulder members depending into inwardly tapered sections each of which flare outwardly at the bottom thereof into a second pair of shoulder members, said second pair of shoulder members being integral with each other at the base section of said frame, said base section being adapted to be parallel to said platform; and d. rotation means for coupling said yarn supporting means to said supporting arm, said rotation means suspending said yarn supporting means from said supporting arm, said pivotal member slidably contacting said platform whereby said pivot member is adapted to rotate about its axis upon said platform.

2. A yarn distribution apparatus as defined in claim 1 wherein said pivot member is a sphere uniformly connected to the base section of said supporting frame and aligned with the apex thereof, said spherical member being adapted to contact said platform at a pole thereof and rotate upon said pole.

3. A yarn distribution apparatus as defined in claim 1 wherein the apex of said supporting frame is adapted to be pivotally coupled to a user thereof.

4. A yarn distribution apparatus comprising:

a. a planar platform;

b. a supporting arm depending upwardly from said platform and extending laterally over a portion of said platform;

c. a supporting frame having an apex depending downwardly and laterally outwardly into a first pair of shoulder members, said shoulder members depending downwardly to a pair of parallel, spaced sections separated by a distance which is less than the distance between said first air of shoulder members, said spaced sections, at the bottom thereof, depending outwardly into a second pair of shoulder members, the distance therebetween being substantially the same as the distance between said first pair of shoulder members, said second pair of shoulder members being integral with each other at the base section of said supporting frame, said base section being adapted to be parallel to said platform, and;

d. rotation means for coupling said yarn supporting means to said supporting arm, said rotation means suspending said yarn supporting means for said supporting arm, said pivot member slidably contacting said platform whereby said pivot member is adapted to rotate about its axis upon said platform.

5. A yarn distribution apparatus as defined in claim 4 wherein said pivot member is a sphere uniformly connected to the base section of said supporting frame and aligned with the apex thereof, said spherical member being adapted to contact said platform at a pole thereof and rotate about its axis upon said pole.

* * * * *